United States Patent [19]

Vermeer et al.

[11] 4,316,312

[45] Feb. 23, 1982

[54] APPARATUS FOR INTERMITTENT APPLICATION OF FLUID TO YARN AT A TEXTURING DEVICE

[75] Inventors: Dick C. Vermeer, Chester; Raymond J. Biron, Colonial Heights, both of Va.

[73] Assignee: Allied Corporation, Morris Township, Morris County, N.J.

[21] Appl. No.: 188,796

[22] Filed: Sep. 19, 1980

[51] Int. Cl.[3] ..... D02G 1/12; D02G 1/16

[52] U.S. Cl. ..... 28/255; 28/267; 8/483; 68/200; 68/205 R

[58] Field of Search ..... 28/255, 267; 68/200, 68/205 R; 8/483; 118/683

[56] References Cited

U.S. PATENT DOCUMENTS

| | | | |
|---|---|---|---|
| 3,246,625 | 4/1966 | Beaman | 118/683 X |
| 3,420,208 | 1/1969 | Guthrie | 118/683 |
| 3,644,969 | 2/1972 | Guillermin et al. | 28/255 |
| 3,730,892 | 5/1973 | Marshall et al. | 252/75 |
| 3,751,778 | 8/1973 | Grosjean et al. | 28/255 |
| 3,955,254 | 5/1976 | DeLarue et al. | 28/255 |
| 3,956,807 | 5/1976 | Holland | 28/255 |
| 4,203,554 | 5/1980 | Zimmer et al. | 68/205 R X |
| 4,209,610 | 6/1980 | Mares et al. | 260/40 R |

FOREIGN PATENT DOCUMENTS

| | | | |
|---|---|---|---|
| 1921499 | 11/1970 | Fed. Rep. of Germany | 118/683 |
| 2553317 | 6/1977 | Fed. Rep. of Germany | 68/205 R |
| 2139999 | 1/1973 | France | 68/200 |
| 50-40879 | 4/1975 | Japan | 28/267 |

*Primary Examiner*—Robert Mackey

*Attorney, Agent, or Firm*—Richard A. Anderson

[57] ABSTRACT

This invention relates to method and apparatus to intermittently apply a treating fluid to a wad of yarn in a texturing device comprising intermittently injecting the fluid under pressure into at least one port at the texturing device and impregnating the yarn with the fluid for a period long enough for the fluid to coat, react, or bond with the yarn. Continuous injection can be used for chemically reactive agents, which do not affect yarn coloration.

1 Claim, 4 Drawing Figures

APPARATUS FOR INTERMITTENT APPLICATION OF FLUID TO YARN AT A TEXTURING DEVICE

BACKGROUND OF THE INVENTION

This invention relates to a method to space dye or treat with space-resist fluids yarn for carpet or other fabric. More particularly, this invention relates to intermittent application of space-dye or other treating fluid to yarn at a texturing device. Chemically reactive agents which do not affect coloration can also be injected, continuously.

Processes for simultaneous texturing and dyeing or finishing yarn to achieve novel variable color effects are described in U.S. Pat. Nos. 3,644,969 and 3,751,778, both hereby incorporated by reference, in toto. Both prior art processes continuously inject dye or finish fluid onto a wad of textured yarn in a steam jet texturing device.

SUMMARY OF THE INVENTION

This invention is a method to intermittently apply treating fluid to a wad of yarn in a texturing device comprising intermittently injecting the fluid under pressure into at least one port at the texturing device and impregnating the yarn with the fluid for a period long enough for the fluid to coat or react with the yarn.

In addition, this invention provides a method to apply surface modifying fluid, other than dyes, dye-resist and dye-acceptor agents, which chemically reacts with the yarn, to a wad of yarn in a texturing device by injecting the fluid under pressure into at least one port at the texturing device and impregnating the yarn with the fluid for a period long enough for the fluid to react with the yarn surface. The fluid, which reacts with the yarn can be a bonding agent (for other surface modifiers), reactive antistat, plasticizer, reactive fiber surface energy reducer, or lightfastness and ozone-resistant agents. Examples would be the fluorocarbon low surface energy compound to improve soil resistance disclosed in U.S. Pat. No. 4,209,610 hereby incorporated by reference, and the epoxy silane compounds used as bonding agents as disclosed in U.S. Pat. No. 3,730,892 (hereby incorporated by reference) and the like. For these fluids, the apparatus of this invention or the apparatus of U.S. Pat. No. 3,644,969 or U.S. Pat. No. 3,751,778 above could be used.

The method of injection described herein is only typical and for illustration, other intermittent systems could be used. For example, a fluidic oscillator with variable frequency, diodes and special spring loaded nozzle or a solenoid-type pump driven by a variable frequency electrical power supply (frequency modulated invertor) could be used.

Preferably, the injection port is located in the texturing device; alternatively, the injection port is located just after the exit opening of the texturing device. Preferably, the treating fluid is a dye, dye-acceptor agent, or dye-resist agent. Multiple ports can be used to inject different or similar dyes or dye-resist agents into the texturing jet as well as surface modifiers. Preferably, the treating fluid is applied to achieve 0.1 to 15 percent by weight of fluid on weight of the yarn, and the active ingredient dye or dye-resist or surface modifier is applied from a solution containing from about 0.5 to 10 percent by weight of active ingredients. The preferred pulse rate is from about 5 to 20 pulses per second and each pulse duration is preferred from about 10 to 80 milliseconds. The pulse rate modulation is preferred from about 5 to 20 percent. That is, the pulse sequence is slightly varied to prevent a chevroning effect in the final carpet tufted from the yarn produced. The preferred yarn plug flow rate is from about 4 to 10 inches per second and from about 100 to 250 grams per minute. Preferred yarn temperature is from about 140° C. to 160° C. The preferred fluid flow rate of the treating fluid is from about 4 to 30 milliliters per minute. The preferred included angle of spray at the port exit of the injection port is from about 6 to 30 degrees. The preferred pressure at the exit of the injection port is from about 100 to 2500 psig. The preferred distance from the exit of the injection port to the yarn is from about 0.1 to 0.3 inch.

The apparatus of this invention is an apparatus to intermittently apply treating fluid to a wad of yarn in a texturing device comprising a source of the treating fluid, means to create pressure on the fluid, injection means comprising tubing communicating with the source of the fluid and with at least one injection port with an outlet opening at the texturing device and control means to regulate the pulse rate and duration of the fluid flow from the source to the injection port; so that the fluid is intermittently injected onto the yarn wad at the texturing device. Preferably, the means to create pressure is an injector pump with drive motor. Preferably, the control means comprises a flow control downstream of the means to create pressure. More preferably, the control means comprises an inverter drive with frequency modulation for the drive motor for the injector pump. Preferably, the injection port has a valve which is a spring loaded nozzle just above it.

DESCRIPTION OF THE PREFERRED EMBODIMENT

Like numbers indicate like items in all figures.

Figure 2:
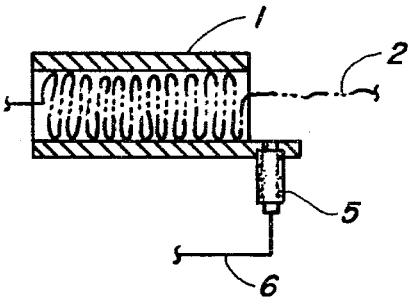
FIG. 2 shows an alternative embodiment.

Yarn 2 from a godet 24 and idler roll 25 enters texturing jet 1 and is textured by the force of steam 3 forcing yarn 2 to impinge on the previously formed wad of yarn 2. As the textured yarn wad moves through the jet 1, treating fluid is intermittently applied through port 4 from spring loaded injection valve 5. The treating fluid enters valve 5 through tubing 6 from flow controller 7, which is in turn fed by injection pump 9 through tubing 8. Injection pump 9 is driven by motor 10 by transmission 22 and cam 23. The frequency of pulses of fluid through injection pump 9 is modulated, to avoid a patterning effect in the yarn 2 being treated, by a frequency modulating electrical inverter 11, electrically connected and supplying electricity to motor 10 through line 12. Treating fluid to injection pump 9 is supplied from hold tank 18 through pump 17 and line 13. Pressure relief valve 26 relieves excess pressure from pump 9 through pipe 14 back to hold tank 18. Valve 15 allows recycle fluid from pump 17 through line 16 back to hold tank 18. Fresh treating fluid is held in make-up tank 20 and supplied to hold tank 18 through line 27 and valve 21 when it is open. Hold tank 18 can be heated by heater 19. In a second embodiment in FIG. 2, the treating fluid can be injected onto yarn 2 by valve 5 located just adjacent the exit of texturing jet 1 as shown.

Figure 3:
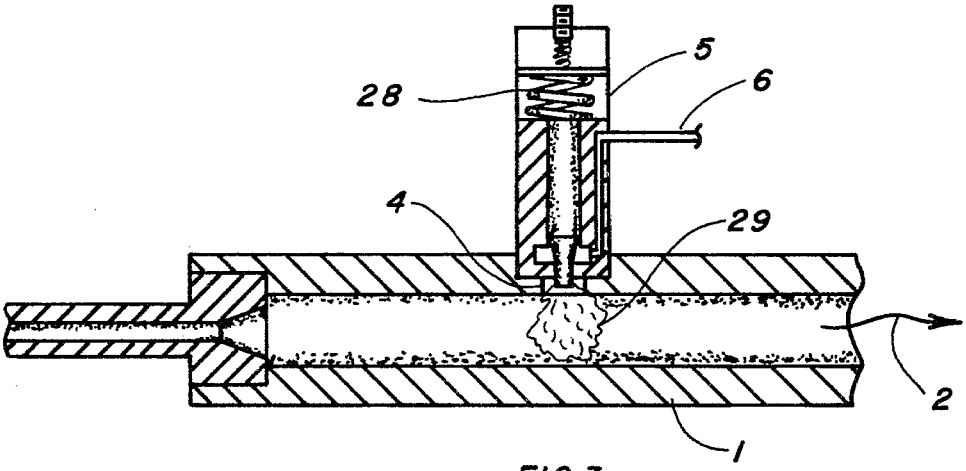
FIG. 3 is a detail cross-section showing a typical spring loaded injection nozzle.

FIG. 3 shows a typical spring loaded injection valve 5 with spring 28. The penetration of fluid is shown at 29.

Figure 4:
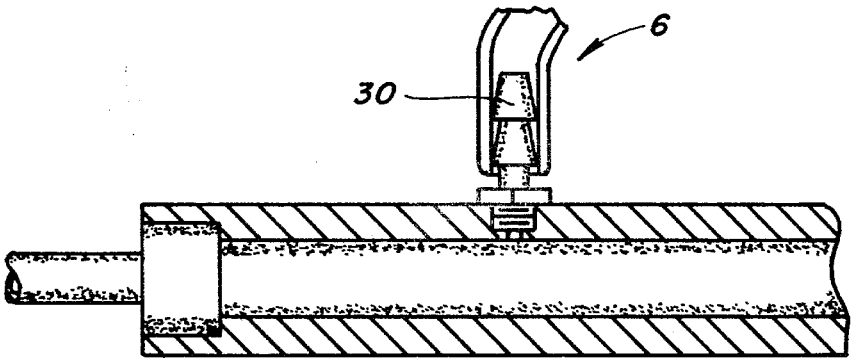
FIG. 4 is a detail cross-section showing a typical fitting for a nonvalved injection port connection.

FIG. 4 shows a typical fitting for injecting chemically reactive fluid when no special dye or coloration effects are desired or when the pulses are determined upstream and the spring loaded injection valve is unnecessary such as with a solenoid-type pump driven by a variable frequency electrical power supply (frequency modulated inverter). The fitting is shown at 30. This fitting could also be used with available prior art fluid supply systems.

EXAMPLE

Figure 1:
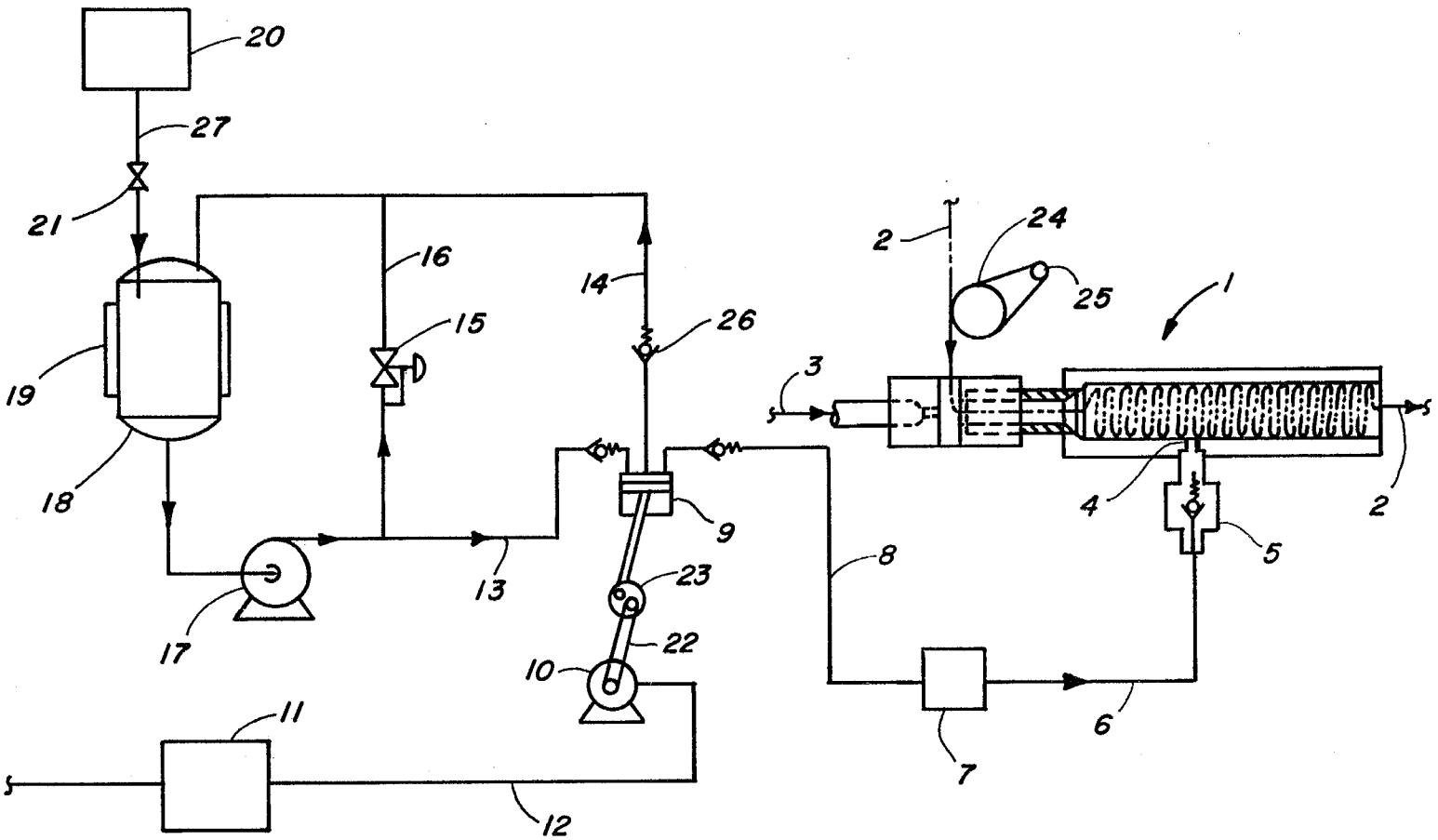
FIG. 1 is a schematic showing a preferred embodiment of the invention.

Using the apparatus described above, FIG. 1, and the operating conditions shown as typical in Table I, Sandospace S, a proprietary space dye-acceptor fluid from Sandoz, is used as the treating fluid to make the treated yarn useful to make multicolor special effect nylon 6 carpet yarn. Alternatively, acid, basic or disperse dyes could be used; also other space dye-resist fluids such as Sandospace R from Sandoz, Erional N.W. from Ciba-Geigy, Mesitol NBS from Verona, or Progalan RTA from Millmaster could be used.

The resultant space-dyed or subsequently dyed space-resist treated yarn will have a variation of dye concentration along the length of the yarn, providing a special color effect fabric when tufted into carpet or other fabric.

A product marketing potential is seen to exist for space treated yarns because:

1. Larger mills can extend their styling capabilities in areas such as:
   (a) long space dye,
   (b) heat-set products,
   (c) residential twist loop,
   (d) contract and print products,
   (e) tone-on-tone effects, and
   (f) barber-style effects.
2. Smaller mills will have increased access to coloration effects without heavy capital investment for printers or Kusters.
3. Substantial beck dyeing capacity exists within industry.
4. A space treat yarn eliminates need for space dye precolored carpet yarn inventory.
5. Provides short runs economy, in particular with Kusters.

The fluids which react with the surface of the yarn or fiber can be useful to bond other agents to the yarn in the manner of the epoxy silanes disclosed in U.S. Pat. No. 3,730,892 above to create new surface modified fibers. Also, chemically reactive antistatic, antiozone, lightfastness, soil resistant agents and plasticizers would create carpet or other fabric with extended life and long-term consumer benefits in improved fading, soiling, and static or shock-resistance.

TABLE I

OPERATING CONDITIONS FOR SPACE TREAT SYSTEM FOR CONTINUOUS AND INTERMITTENT OPERATIONS

| Parameters | Range | Typical |
|---|---|---|
| Application Level, Percent (By Wt.) | 0.1–20 | 4 |
| Active Chemical Ingredient Concentration, Percent (By Wt.) | 0.5–10 | 2 |
| Pulse Rate, Pulses Per Second | 1–20 | 12 |
| Pulse Rate Modulation, Percent | 5–20 | 12 |
| Pulse Duration, Milliseconds | 10–80 | 15 |
| Liquid Flow, Average, Milliliters Per Minute | 4–30 | 6 |
| Nozzle Spray Angle, Degrees | 6–30 | 12 |
| Nozzle Liquid Exit Pressure, psig | 100–5000 | 1600 |
| Distance Nozzle Head to Target, Inch | 0.1–0.3 | 0.1 |
| Yarn Plug Flow Rate, Inches Per Second | 4–10 | 6 |
| Yarn Mass Flow, Grams Per Minute | 100–250 | 210 |
| Yarn Temperature, °C. | 140–160 | 150 |

We claim:

1. An apparatus to intermittently apply treating fluid to a wad of yarn in a texturing device comprising
a source of said fluid,
an injector pump with drive motor and an inverter drive with frequency modulation to create pressure on said fluid, injection means comprising
(a) tubing communicating with said source of said fluid
and with at least one
(b) injection port having a valve which is a spring loaded nozzle with an outlet opening at the texturing device
(c) a flow control downstream of said means to create pressure to regulate the pulse rate and duration of said fluid flow from said source to said injection port
so that said fluid is intermittently injected onto said yarn wad at said texturing device.

* * * * *